US009219313B2

(12) United States Patent
Georgescu et al.

(10) Patent No.: US 9,219,313 B2
(45) Date of Patent: Dec. 22, 2015

(54) ANTENNA WITH EFFECTIVE AND ELECTROMAGNETIC BANDGAP (EBG) MEDIA AND RELATED SYSTEM AND METHOD

(71) Applicant: Honeywell International, Inc., Morristown, NJ (US)

(72) Inventors: Ion Georgescu, Bucharest (RO); Cazimir G. Bostan, Bucharest (RO); Fouad Nusseibeh, Champlin, MN (US)

(73) Assignee: Honeywell International Inc., Morris Plains, NJ (US)

( * ) Notice: Subject to any disclaimer, the term of this patent is extended or adjusted under 35 U.S.C. 154(b) by 464 days.

(21) Appl. No.: 13/750,799

(22) Filed: Jan. 25, 2013

(65) Prior Publication Data

US 2013/0207867 A1 Aug. 15, 2013

(30) Foreign Application Priority Data

Feb. 10, 2012 (EP) ..... 12155014

(51) Int. Cl.

| | |
|---|---|
| ***H01Q 1/38*** | (2006.01) |
| ***H01Q 15/00*** | (2006.01) |
| ***H01P 11/00*** | (2006.01) |
| ***H01Q 9/04*** | (2006.01) |
| ***H01Q 21/06*** | (2006.01) |

(52) U.S. Cl.

CPC ..... *H01Q 15/0026* (2013.01); *H01P 11/001* (2013.01); *H01Q 9/0457* (2013.01); *H01Q 15/006* (2013.01); *H01Q 15/0013* (2013.01); *H01Q 21/065* (2013.01); *Y10T 29/49016* (2015.01)

(58) Field of Classification Search

USPC ..... 343/700 MS, 719, 893

See application file for complete search history.

(56) References Cited

U.S. PATENT DOCUMENTS

| | | | | |
|---|---|---|---|---|
| 8,711,055 | B2 * | 4/2014 | Cho et al. | 343/909 |
| 2007/0285336 | A1 * | 12/2007 | Kamgaing | 343/895 |
| 2012/0154234 | A1 * | 6/2012 | Geiler et al. | 343/787 |
| 2013/0181880 | A1 * | 7/2013 | Shen et al. | 343/853 |

FOREIGN PATENT DOCUMENTS

DE 10 2005 051 154 A1 5/2007

OTHER PUBLICATIONS

European Search Report dated Jun. 29, 2012 in connection with European Patent Application No. EP 12 15 5014.

Channabasappa Eswarappa, et al. "Periodic Filters for Performance Enhancement of Millimeter-wave Microstrip Antenna Arrays", IEEE 2004, Jun. 6, 2004, p. 353-356.

(Continued)

*Primary Examiner* — Tan Ho

(57) ABSTRACT

An apparatus includes an antenna having multiple layers. At least a first of the layers includes both an effective medium and an electromagnetic bandgap (EBG) medium. The antenna could include a ground plane and a feed line, and the first layer of the antenna can be located between the ground plane and the feed line. The antenna could also include a slot ground and a planar antenna structure, and the first layer of the antenna could be located between the slot ground and the planar antenna structure. The antenna could further include a first substrate between a feed line and a slot ground and a second substrate covering a planar antenna structure, and the first layer could include one of the first and second substrates.

20 Claims, 3 Drawing Sheets

(56) References Cited

OTHER PUBLICATIONS

Reberto Coccioli, et al., "Aperture-Coupled Patch Antenna on UC-PBG Substrate", IEEE Transactions on Microwave Theory and Techniques, vol. 47, No. 11, Nov. 1999, p. 2123-2130.

Martin Coulombe, et al., "Compact Elongated Mushroom (EM)-EBG Structure for Enhancement of Patch Antenna Array Performances", IEEE Transactions on Antannas and Propagation, vol. 58, No. 4, Apr. 2010, p. 1076-1086.

Chunheng Liu, et al., "A High Gain and Broadband C-Band Aperture-Coupled Patch Antenna", Int. J Infrared Milli Waves, Oct. 17, 2007, p. 1115-1122.

D. Qu, et al., "Improving microstrip patch antenna performance using EBG substrates", IEE Proc.-Microw. Antennas Propag., vol. 153, No. 6, Dec. 2006, p. 558-563.

Fan Yang, et al., "Microstrip Antennas Integrated With Electromagnetic Band-Gap (EBG) Structures: A Low Mutual Coupling Design for Array Applications", IEEE Transactions on Antennas and Propagation, vol. 51, No. 10, Oct. 2003, p. 2936-2946.

Ramon Gonzalo, et al., "Enhanced Patch-Antenna Performance by Suppressing Surface Waves Using Photonic-Bandgap Substrates", IEEE Transactions on Microwave Theory and Techniques, vol. 47, No. 11, Nov. 1999, p. 2131-2138.

Gildas P. Gauthier, et al., "Microstrip Antennas on Synthesized Low Dielectric-Constant Substrates", IEEE Transactions on Antennas and Propagation, vol. 45, No. 8, Aug. 1997, p. 1310-1314.

Joseph S. Colburn, et al., "Patch Antennas on Externally Perforated High Dielectric Constant Substrates", IEEE Transactions on Antennas and Propagation, vol. 47, No. 12, Dec. 1999, p. 1785-1794.

Philippe Lalanne, et al., "Artificial Media Optical Properties—Subwavelength Scale", Encyclopedia of Optical Engineering, 2003, p. 62-71.

* cited by examiner

ANTENNA WITH EFFECTIVE AND ELECTROMAGNETIC BANDGAP (EBG) MEDIA AND RELATED SYSTEM AND METHOD

CROSS-REFERENCE TO RELATED APPLICATION AND PRIORITY CLAIM

This application claims priority under 35 U.S.C. §119 to European Patent Application No. EP 12155014 filed on Feb. 10, 2012, which is hereby incorporated by reference.

TECHNICAL FIELD

This disclosure relates generally to wireless devices. More specifically, this disclosure relates to an antenna with effective and electromagnetic bandgap (EBG) media and a related system and method.

BACKGROUND

Numerous systems use wireless technology in some manner, and antennas often play a major role in the performance of those systems. Various parameters of an antenna include bandwidth, directivity, gain, and impedance matching. One antenna implementation that achieves a good compromise among these parameters is a planar patch antenna.

For radar sensing applications (such as radar gauging for tank level measurements), antennas may need specific bandwidths and high directivity. High directivity is typically needed to reduce parasitic reflections from a storage tank's metallic walls. Radar sensing antennas also often need lower return losses and phase distortions to avoid incorrect level measurements, particularly at short distances. In addition, internal reflections due to surface waves inside the antennas often need to be minimized.

Conventional radar sensing systems often satisfy these criteria by decreasing a substrate height or using a low dielectric constant material (such as foam) in an antenna. However, decreasing the substrate height decreases antenna bandwidth. Also, the use of foam typically results in low production yields due to difficulties in controlling foam thickness, which increases manufacturing costs.

SUMMARY

This disclosure provides an antenna with effective and electromagnetic bandgap (EBG) media and a related system and method.

In a first embodiment, an apparatus includes an antenna having multiple layers. At least a first of the layers includes both an effective medium and an electromagnetic bandgap (EBG) medium.

In particular embodiments, the antenna includes a ground plane and a feed line. Also, the first layer of the antenna is located between the ground plane and the feed line.

In other particular embodiments, the antenna includes a slot ground and a planar antenna structure. Also, the first layer of the antenna is located between the slot ground and the planar antenna structure.

In still other particular embodiments, the antenna includes a first substrate between a feed line and a slot ground and a second substrate covering a planar antenna structure. Also, the first layer includes one of the first and second substrates.

In a second embodiment, a system includes an antenna array having multiple antennas. Each of the antennas includes multiple layers. At least a first of the layers in each antenna includes both an effective medium and an electromagnetic bandgap (EBG) medium.

In a third embodiment, a method includes forming a first layer of a multi-layer antenna and forming a second layer of the multi-layer antenna. At least one of the layers includes both an effective medium and an electromagnetic bandgap (EBG) medium.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 4, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
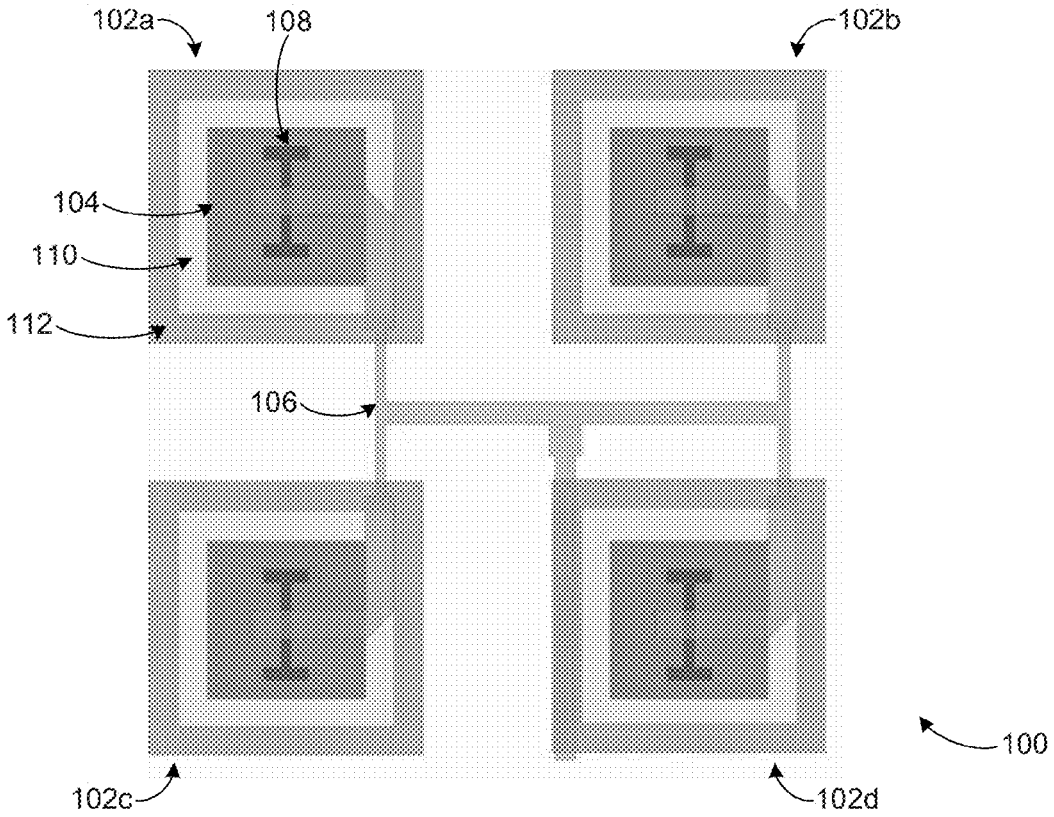
FIG. 1 illustrates an example antenna array according to this disclosure.

FIG. 1 illustrates an example antenna array 100 according to this disclosure. As shown in FIG. 1, the antenna array 100 includes multiple antennas 102*a*-102*d*. In this example, the antenna array 100 includes four patch antennas 102*a*-102*d*. However, the antenna array 100 could include any number and type of individual antennas.

In FIG. 1, each antenna 102*a*-102*d* includes a conductive patch 104. The conductive patch 104 generally denotes a conductive structure that radiates and/or receives electromagnetic signals to support wireless communications. The conductive patch 104 can be formed from any suitable material(s) (such as one or more metals) and in any suitable manner. The conductive patch 104 can also have any suitable size and shape (such as rectangular).

Each antenna 102*a*-102*d* is coupled to an external feed network 106. The feed network 106 generally represents one or more conductive paths along which outgoing signals are provided to the antennas 102*a*-102*d* for transmission and/or incoming signals are received from the antennas 102*a*-102*d*. The feed network 106 includes any suitable structure for transporting signals, such as metal or other conductive traces or signal lines. As a particular example, the feed network 106 could be formed using microstrip lines, striplines, coplanar waveguides, or other types of transmission line(s).

In this example, aperture coupling is used to couple the conductive patches 104 in the antennas 102*a*-102*d* to the feed network 106. In aperture coupling, a slot 108 is formed in a layer of an antenna between the conductive patch 104 and the feed network 106. The slot 108 could have any suitable size and shape. The slot 108 could also be formed in any suitable manner, such as by depositing and etching material.

In accordance with this disclosure, one or more antennas in the array 100 also include at least one effective medium 110 and at least one electromagnetic bandgap (EBG) medium 112. In this example, the EBG medium 112 is around and substantially or completely surrounds the effective medium 110. Effective and electromagnetic bandgap media 110-112 each generally includes one or more materials with a periodic pattern. Effective and EBG media 110-112 both play a role in a given frequency bandwidth for an antenna, but they differ in their characteristic length scale of patterning. Effective media patterning is done at a length scale much smaller than a working wavelength of an antenna. EBG media patterning is done at a length scale typically equal to a fraction of the working wavelength so as to obtain a forbidden frequency band centered around a working frequency. The effective and EBG media 110-112 have particular properties (such as anisotropy, low refractive index, and forbidden frequency band) that can be tuned. The tuning can be accomplished, for instance, by geometry patterning in standard dielectric or metallic materials.

By combining both effective and EBG media techniques, the array 100 can obtain an adequately wide bandwidth at higher efficiency with lower cross-coupling compared to conventional patch arrays. An effective medium 110 with a low dielectric constant substrate can be used to obtain wider bandwidths and higher efficiencies, while an EBG medium 112 between antennas can be used to suppress radiation in horizontal directions to reduce cross-coupling between adjacent antennas. The EBG medium 112 can also reduce multipath reflections in the array 100, which may be particularly useful in radar applications since multipath reflections can give rise to false signals. These benefits can be obtained using a smaller antenna array, helping to reduce the size of the final system. In addition, production of the antenna array 100 can have higher production yields, helping to reduce the manufacturing cost of the array 100.

The medium 110 represents any suitable effective medium having periodic patterning that is much smaller than a wavelength of interest. The medium 112 represents any suitable EBG medium having periodic patterning that is closer in size to a wavelength of interest. The media 110-112 could also be formed in any suitable manner. Additional details regarding the use of effective and EBG media in an antenna are provided below.

Although FIG. 1 illustrates one example of an antenna array 100, various changes may be made to FIG. 1. For example, while the above description has described the use of effective and EBG media in an antenna array, effective and EBG media could be used with a single antenna. Also, while described as including patch antennas, the array 100 could include any other suitable type of antenna.

Figure 2:
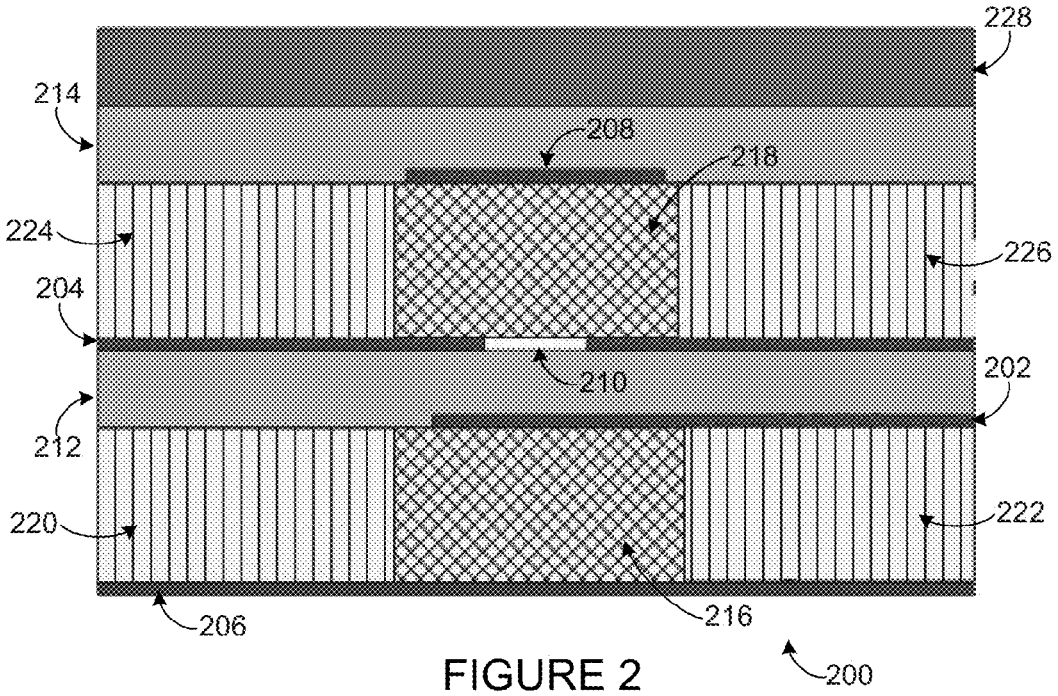
FIG. 2 illustrates an example cross-section of an antenna according to this disclosure.

FIG. 2 illustrates an example cross-section of an antenna 200 according to this disclosure. The cross-section in FIG. 2 could, for example, represent a cross-section taken horizontally through the middle of any of the antennas 102*a*-102*d* shown in FIG. 1. Note, however, that the antenna 200 could be used individually or in any other suitable array.

As shown in FIG. 2, the antenna 200 represents a multilayer structure that includes a feed line 202, a slot ground 204, a ground plane 206, and a planar antenna structure 208. The feed line 202 can be coupled to an external device or system and is used to provide signals to the antenna structure 208 for transmission and/or to receive signals from the antenna structure 208. For instance, the feed line 202 could be coupled to or form a part of the feed network 106. The slot ground 204 and the ground plane 206 represent grounded elements above and below the feed line 202. The slot ground 204 includes a slot 210, which could have any suitable size and shape and may contain any suitable material(s) (such as air). The planar antenna structure 208 generally operates to radiate and receive electromagnetic signals.

Each of the components 202-208 in the antenna 200 could be formed from any suitable material(s), such as copper or other metal or conductive material. Also, each of the components 202-208 could be formed in any suitable manner, such as by deposition of a metal followed by a pattern and etch procedure. Further, the slot 210 could be formed in any suitable manner, such as during etching of the slot ground 204. In addition, each component 202-208 could have any suitable thickness according to particular needs.

As shown in FIG. 2, a feed substrate 212 separates the feed line 202 and the slot ground 204. Also, an antenna substrate 214 covers the planar antenna structure 208. Each substrate 212-214 could be formed from any suitable material(s). For example, each substrate 212-214 could be formed from a DUROID or DECLAD laminate (for lower frequencies) or a silicon, gallium arsenide, or Low Temperature Co-fired Ceramic (LTCC) substrate (for higher frequencies). Also, each substrate 212-214 could have any suitable thickness according to particular needs.

As noted above, at least one layer in an antenna can include both effective and EBG media. In FIG. 2, the antenna 200 includes effective media 216-218 and EBG media 220-226. The effective and EBG media 216-226 represent areas that are patterned differently. The effective media 216-218 are patterned at a length scale much smaller than a working wavelength of the antenna 200, and the EBG media 220-226 are patterned at a length scale closer to the working wavelength of the antenna 200 (typically at a larger fraction of the working wavelength). The effective media 216-218 is therefore patterned at a length scale smaller than that of the EBG media 220-226.

Each of the effective media 216-218 and EBG media 220-226 can be formed from any suitable material(s) and in any suitable manner. For example, each of the effective media 216-218 could include a two-dimensional array of closely-spaced holes through that medium down to the underlying ground. The spacing between the holes in the effective media 216-218 is much smaller than the working wavelength of the antenna 200. The EBG media 220-226 can include an array of vias and pads. The spacing between the vias in the EBG media 220-226 is larger than the spacing between the holes in the effective media 216-218. Note that the EBG media 220-222 could represent portions of a single effective medium (such as a ring as shown in FIG. 1), and the same is true for EBG media 224-226.

The holes or vias in the media 216-226 can be formed in any suitable manner. For example, micromachining techniques can be used to etch or drill through the material forming the media 216-226. When working frequencies are lower (such as on the order of tens of giga-Hertz), the media can be fabricated using standard PCB technology, such as by using a numerically controlled machine (NCM). When the working frequency is higher (such as above 100 GHz), techniques such as reactive ion etching or focused ion beam etching can be used.

By combining effective and EBG media in a single same layer as shown here, the antenna 200 obtains adequate bandwidth at higher efficiency with lower cross-coupling to any adjacent antennas. The antenna 200 can also suffer from reduced multipath reflections within the antenna 200 itself.

A cover 228 protects the lower layers in the antenna 200. The cover 228 could be formed in any suitable manner and from any suitable material(s), such as a dielectric. Also, the cover 228 could have any suitable thickness, such as one selected based on the working frequency of the antenna 200.

Although FIG. 2 illustrates one example of a cross-section of an antenna 200, various changes may be made to FIG. 2. For example, each component in FIG. 2 could have any suitable size, shape, and dimensions. Also, while FIG. 2 illustrates the use of aperture coupling to couple the feed line 202 to the planar antenna structure 208 through the slot 210, other coupling mechanisms could be used, such as a microstrip line feed, a coaxial line feed, or a proximity coupling feed. In addition, note that a combination of effective and EBG media could be used in other layers of the antenna 200, such as in the feed substrate 212 or the antenna substrate 214.

Figure 3:
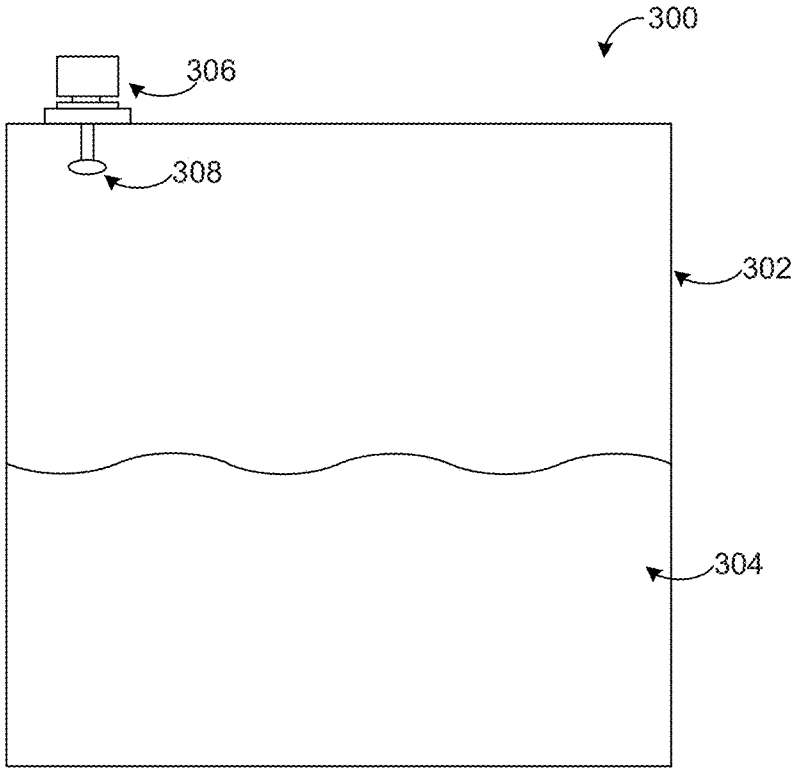
FIG. 3 illustrates an example radar gauging system using an antenna according to this disclosure.

FIG. 3 illustrates an example radar gauging system 300 using an antenna according to this disclosure. As shown in FIG. 3, the system 300 includes a tank 302 that can store one or more materials 304. The tank 302 represents any suitable structure for receiving and storing at least one liquid or other material. The tank 302 could, for example, represent an oil storage tank or a tank for storing other liquid(s) or other material(s). The tank 302 could also have any suitable shape and size. Further, the tank 302 could form part of a larger structure. The larger structure could represent any fixed or movable structure containing or associated with one or more tanks 302, such as a movable tanker vessel, railcar, or truck or a fixed tank farm.

A level gauge 306 measures the level of material 304 in the tank 302. For example, the level gauge 306 could transmit radar signals towards the material 304 in the tank 302 and receive radar signals reflected off the material 304 in the tank 302. The level gauge 306 can then analyze the signals to identify the level of material in the tank, such as by using time-of-flight calculations or other calculations.

In this example, at least one antenna 308 is used to transmit the radar signals towards the material 304 and/or to receive the radar signals reflected from the material 304. The antenna 308 uses a combination of effective and EBG media to obtain adequate bandwidth and efficiency with suitably low cross-coupling and reduced multipath reflections. The antenna 308 could include a single antenna (such as the antenna 200 of FIG. 2) or an antenna array (such as the array 100 of FIG. 1).

Although FIG. 3 illustrates one example of a radar gauging system 300 using an antenna, various changes may be made to FIG. 3. For example, other or additional components could be present in the system 300, such as control components for controlling the loading and unloading of the tank 302 based on the level measurements from the gauge 306. Also, the level gauge 306 could include any other suitable functionality, such as an alarm capability that signals when the material 304 is close to reaching the top of the tank 302. In addition, note that FIG. 3 illustrates one example operational environment where an antenna including both effective and EBG media can be used. An antenna including both effective and EBG media could be used in any other suitable device or system.

Figure 4:
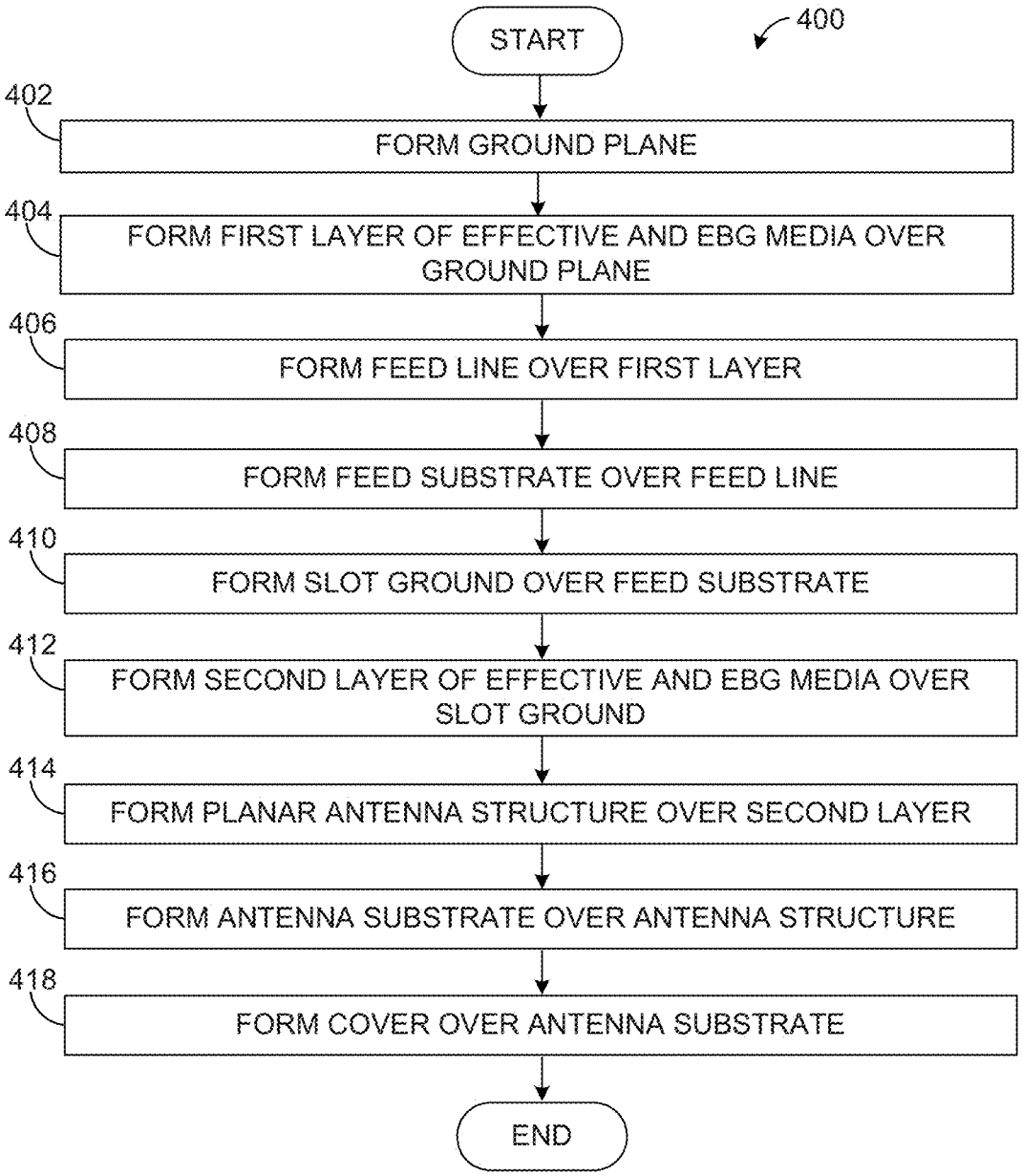
FIG. 4 illustrates an example method for forming an antenna according to this disclosure.

FIG. 4 illustrates an example method 400 for forming an antenna according to this disclosure. As shown in FIG. 4, a ground plane is formed at step 402. This could include, for example, forming the ground plane 206 on an underlying substrate or sacrificial layer, such as by depositing and etching a layer of copper.

A first layer containing effective and EBG media is formed over the ground plane at step 404. This could include, for example, depositing a layer of dielectric or other material(s) over the ground plane 206. This could also include masking regions where the EBG media 220-222 are to be formed and etching holes in the layer to form the effective medium 216. This could further include masking the regions where the effective medium 216 is formed and etching vias and performing other operations to form the EBG media 220-222. Note that any other combination of operations could be used to form the effective medium 216 and the EBG media 220-222.

A feed line is formed over the first layer of effective and EBG media at step 406. This could include, for example, forming the feed line 202 by depositing and etching a layer of copper. A feed substrate is formed over the feed line at step 408. This could include, for example, forming the feed substrate 212 by depositing dielectric or other material(s) over the feed line 202. A slot ground is formed over the feed substrate at step 410. This could include, for example, forming the slot ground 204 by depositing a layer of copper and etching the copper to form the slot 210.

A second layer containing effective and EBG media is formed over the slot ground at step 412. This could include, for example, depositing a layer of dielectric or other material (s) over the slot ground 204. This could also include masking regions where the EBG media 224-226 are to be formed and etching holes in the layer to form the effective medium 218. This could further include masking the regions where the effective medium 218 is formed and etching vias and performing other operations to form the EBG media 224-226. Note that any other combination of operations could be used to form the effective medium 218 and the EBG media 224-226.

A planar antenna structure is formed over the second layer of effective and EBG media at step 414. This could include, for example, forming the planar antenna structure 208 by depositing and etching a layer of copper. The planar antenna structure could have any suitable size and shape. An antenna substrate is formed over the antenna structure at step 416. This could include, for example, forming the antenna substrate 214 by depositing dielectric or other material(s) over the planar antenna structure 208. A cover is formed over the antenna substrate at step 418. This could include, for example, forming the cover 228 by depositing dielectric or other material(s) over the antenna substrate 214.

Although FIG. 4 illustrates one example of a method 400 for forming an antenna, various changes may be made to FIG. 4. For example, while FIG. 4 has been described as using effective and EBG media in a multi-layer patch antenna supporting aperture coupling, effective and EBG media can be used with any other suitable antenna. Also, while described as a series of steps, various steps in FIG. 4 could overlap, occur in parallel, or occur in a different order.

It may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

an antenna comprising multiple layers;

wherein at least a first of the layers comprises both an effective medium and an electromagnetic bandgap (EBG) medium;

wherein the effective medium and the EBG medium are areas that are patterned differently in that material in the effective medium is patterned at a length scale smaller than a length scale of material in the EBG medium, the length scale of the EBG medium closer to a working wavelength of the antenna than the length scale of the effective medium.

2. The apparatus of claim 1, wherein:

the antenna comprises a ground plane and a feed line; and the first layer of the antenna is located between the ground plane and the feed line.

3. The apparatus of claim 1, wherein the antenna comprises:

a first substrate between a feed line and a slot ground; and a second substrate covering a planar antenna structure.

4. The apparatus of claim 3, wherein the first layer comprises one of the first and second substrates.

5. The apparatus of claim 1, wherein each layer comprising effective and EBG media includes the EBG medium surrounding the effective medium.

6. The apparatus of claim 1, further comprising:

a radar gauge configured to at least one of: transmit radar signals towards material in a tank and receive radar signals reflected off the material in the tank using the antenna.

7. An apparatus comprising:

an antenna comprising multiple layers;

wherein:

at least a first of the layers comprises both an effective medium and an electromagnetic bandgap (EBG) medium;

the antenna comprises a slot ground and a planar antenna structure; and the first layer of the antenna is located between the slot ground and the planar antenna structure.

8. An apparatus comprising:

an antenna comprising multiple layers;

wherein:

at least a first of the layers comprises both an effective medium and an electromagnetic bandgap (EBG) medium;

the antenna comprises a ground plane, a feed line, a slot ground, and a planar antenna structure;

the first layer of the antenna is located between the ground plane and the feed line; and a second of the layers of the antenna comprises both a second effective medium and a second EBG medium, the second layer located between the slot ground and the planar antenna structure.

9. A system comprising:

an antenna array comprising multiple antennas, each of the antennas comprising multiple layers;

wherein at least a first of the layers in each antenna comprises both an effective medium and an electromagnetic bandgap (EBG) medium; and wherein the effective medium and the EBG medium in each antenna are areas that are patterned differently in that material in the effective medium is patterned at a length scale smaller than a length scale of material in the EBG medium, the length scale of the EBG medium closer to a working wavelength of the respective antenna than the length scale of the effective medium.

10. The system of claim 9, wherein:

each of the antennas comprises a ground plane and a feed line; and the first layer of each antenna is located between the ground plane and the feed line of that antenna.

11. The system of claim 9, wherein each antenna comprises:

a first substrate between a feed line and a slot ground of that antenna; and a second substrate covering a planar antenna structure of that antenna.

12. The system of claim 11, wherein the first layer of each antenna comprises one of the first and second substrates of that antenna.

13. The system of claim 9, wherein each layer comprising effective and EBG media includes the EBG medium surrounding the effective medium.

14. The system of claim 9, wherein the antenna array comprises multiple patch antennas coupled to a feed network.

15. A system comprising:

an antenna array comprising multiple antennas, each of the antennas comprising multiple layers;

wherein:

at least a first of the layers in each antenna comprises both an effective medium and an electromagnetic bandgap (EBG) medium;

each antenna comprises a slot ground and a planar antenna structure; and the first layer of each antenna is located between the slot ground and the planar antenna structure of that antenna.

16. A system comprising:

an antenna array comprising multiple antennas, each of the antennas comprising multiple layers;

wherein:

at least a first of the layers in each antenna comprises both an effective medium and an electromagnetic bandgap (EBG) medium;

each antenna comprises a ground plane, a feed line, a slot ground, and a planar antenna structure;

the first layer of each antenna is located between the ground plane and the feed line of that antenna; and a second of the layers in each antenna comprises both a second effective medium and a second EBG medium, the second layer of each antenna located between the slot ground and the planar antenna structure of that antenna.

17. A method comprising:

forming a first layer of a multi-layer antenna; and forming a second layer of the multi-layer antenna;

wherein at least one of the layers comprises both an effective medium and an electromagnetic bandgap (EBG) medium; and wherein material in the effective medium and material in the EBG medium are patterned differently, wherein the patterning of the material in the effective medium is at a length scale smaller than a length scale of the material in the EBG medium patterning, the length scale of the EBG medium closer to a working wavelength of the antenna than the length scale of the effective medium.

18. The method of claim 17, wherein:

the antenna comprises a ground plane and a feed line; and the layer comprising effective and EBG media is located between the ground plane and the feed line.

19. The method of claim 17, wherein:

the antenna comprises a first substrate between a feed line and a slot ground and a second substrate covering a planar antenna structure; and the layer comprising effective and EBG media comprises one of the first and second substrates.

20. A method comprising:

forming a first layer of a multi-layer antenna; and forming a second layer of the multi-layer antenna;

wherein:

at least one of the layers comprises both an effective medium and an electromagnetic bandgap (EBG) medium;

the antenna comprises a slot ground and a planar antenna structure; and the layer comprising effective and EBG media is located between the slot ground and the planar antenna structure.

* * * * *